US005320353A

United States Patent [19]

Moore

[11] Patent Number: 5,320,353

[45] Date of Patent: Jun. 14, 1994

[54] GOLF CLUB

[76] Inventor: James T. Moore, 2003 Foxcroft Rd., La Grange, Ga. 30240

[21] Appl. No.: 99,126

[22] Filed: Jul. 29, 1993

[51] Int. Cl.[5] ..... A63B 53/04

[52] U.S. Cl. ..... 273/167 F; 273/169; 273/173

[58] Field of Search ..... 273/167 R-177 A, 273/77 R, 164.1, 193 R, 194 R, 194 A

[56] References Cited

U.S. PATENT DOCUMENTS

| | | | |
|---|---|---|---|
| D. 161,790 | 1/1951 | Sappington . | |
| D. 222,280 | 10/1971 | Cook . | |
| D. 241,957 | 10/1976 | Melton . | |
| D. 257,871 | 1/1981 | MacDougall . | |
| D. 274,346 | 6/1984 | Giebel et al. . | |
| D. 294,512 | 3/1988 | Antonious . | |
| D. 299,044 | 12/1988 | Antonious . | |
| 1,291,967 | 1/1919 | McDougal . | |
| 1,349,806 | 8/1920 | Booth | 273/172 |
| 1,355,889 | 10/1920 | Campbell | 273/172 |
| 1,413,854 | 4/1922 | Kraeuter | 273/173 |
| 1,483,614 | 2/1924 | Reach | 273/169 |
| 1,485,685 | 3/1924 | McMahon | 273/173 X |
| 1,538,415 | 5/1925 | Tootle | 273/172 |
| 1,567,248 | 12/1925 | Dahlman | 273/173 X |
| 1,589,363 | 6/1926 | Butchart . | |
| 1,666,174 | 3/1927 | Holland . | |
| 1,916,792 | 7/1933 | Hadden | 273/167 H |
| 2,332,342 | 10/1943 | Reach | 273/171 |
| 2,491,383 | 12/1949 | Liolich . | |
| 2,756,055 | 7/1956 | Bittner . | |
| 3,333,854 | 4/1964 | White . | |
| 3,954,265 | 5/1976 | Taylor . | |
| 4,025,078 | 5/1977 | Pelz | 273/171 X |
| 4,569,524 | 2/1986 | Quijano . | |
| 4,824,115 | 4/1989 | Walther . | |
| 4,826,172 | 5/1989 | Antonious | 273/169 |
| 4,852,880 | 8/1989 | Kobayashi | 273/167 F X |
| 4,872,685 | 10/1989 | Sun | 273/169 |
| 4,883,275 | 11/1989 | Boone | 273/172 |
| 5,013,041 | 5/1991 | Sun | 273/167 A |
| 5,211,401 | 5/1993 | Hainey | 273/167 R X |

FOREIGN PATENT DOCUMENTS 2248 of 1894 United Kingdom .

*Primary Examiner*—Vincent Millin
*Assistant Examiner*—Sebastiano Passaniti
*Attorney, Agent, or Firm*—Watson, Cole, Grindle & Watson

[57] ABSTRACT

There has been disclosed a golf club head having a body with a T-shaped recess and a visually distinguishable T-shaped weight. The weight extends transversely from the striking face and rearwardly of the club. The T-shaped weight concentrates the actual mass of the club near the center of mass which is located within the transverse portion above a central horizontal plane. The width dimension of the rearwardly extending portion of the weight defines the strike zone, in which the force applied to the ball is optimum and rotation of the club is minimized whenever two points on the ball are within the dimension.

17 Claims, 2 Drawing Sheets 35
37

$R_C$ (S-S)
$R_C$(S-S)

FRONT
TOE
(A)
(B)
REAR
HEEL
DISTANCE FROM CENTER $\phi_a$
$\theta$
$R_C$(F-R)
8
38
66
36
64
8

$\phi_b$
$R_C$(S-S)
$R_C$(S-S)
54
58
56

20

GOLF CLUB

BACKGROUND OF THE INVENTION

This invention relates to golf clubs, and in particular to a face balanced golf putter having a weighted and directional insert.

Golf club heads are normally designed with a planar ball striking face which is aligned adjacent the center of gravity of the club. It is desirable to strike the ball at a point on the ball striking face which is in alignment with the direction of travel of the center of gravity. Any deviation from the optimum point of contact causes the head to rotate which reduces the applied force and can cause inaccuracy in the desired direction of travel. The problem has been alleviated somewhat by the incorporation of inertial weights located adjacent the center of gravity in the direction of the toe, located proximate to the point of attachment of the head to the shaft, and heel, located distally of the shaft. In one arrangement, it has been proposed that the problem of rotation of the head and optimization of the force applied to the ball can be achieved by means of a weighted golf head wherein the mass of the applied weight increases with distance from the center of gravity and decreases towards the rear or back of the club head. The described arrangement has an integral block formed of brass cast within the golf head with four distinct weight areas, namely a pair of center weights and a pair of heel and toe weights.

SUMMARY OF THE INVENTION

The present invention is based upon the discovery that a golf club may be formed with a club head receiving a relatively dense weighted insert which locates the center of gravity of the club at a selected elevated central location and distributes added inertial weight about the center of mass towards the heel and toe in a gradually decreasing amount. Also, the insert has a weighted trailing portion perpendicular to the club face and aligned with the center of mass and direction of swing. The trailing weight balances the face of the club around the center of gravity and also provides a means for visualizing the optimum impact point on the face of the club. Visualization is further enhanced by employment of a metal having a color different from the head.

In a particular embodiment, the invention comprises a golf club putter comprising a body having a heel portion and a toe portion, a striking face extending from the heel portion to the toe portion and a shaft attachment point adjacent the heel portion. The club has a recess formed therein extending transversely from the heel portion to the toe portion and extending laterally in the direction perpendicular to the face towards the rear of the club head in intersecting relation. A weight having a relative mass or density greater than the body is received within the recess. The club, incorporating the weight and the body, has an elevated center of mass located within the recess where the transverse and lateral portions intersect. The mass of the weight is distributed such that it decreases in the direction extending transversely and laterally from the center of mass. The major portion of the actual mass of the club extends in the lateral direction and is concentrated around the center of mass above a central horizontal plane of the club. The transverse weight causes the club to resist rotation when the ball strikes the club near the center of mass. The elevation of the center of mass causes the ball, when struck, to roll in a more consistent manner. At the same time, the lateral or trailing portion of the weight provides a visual indication of the location of the center of mass. Rotation of the club is minimized when the ball is struck within the boundaries of the lateral recess.

DESCRIPTION OF THE INVENTION

Figure 1:
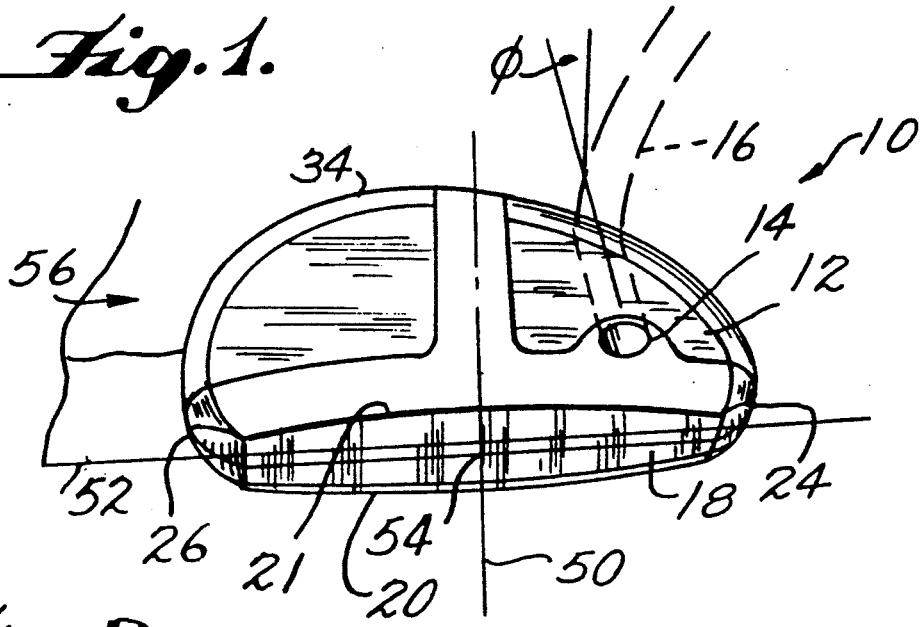
FIG. 1 is a perspective fragmentary view of a golf putter according to the present invention.
Figure 2:
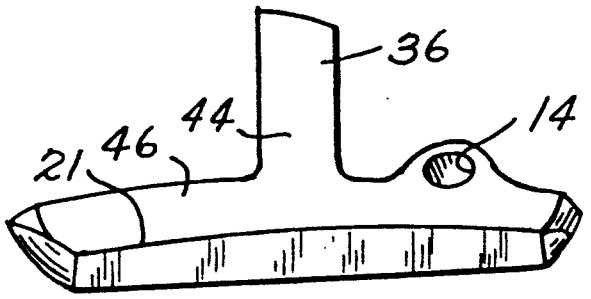
FIG. 2 is an exploded perspective of the golf putter head.
Figure 2:
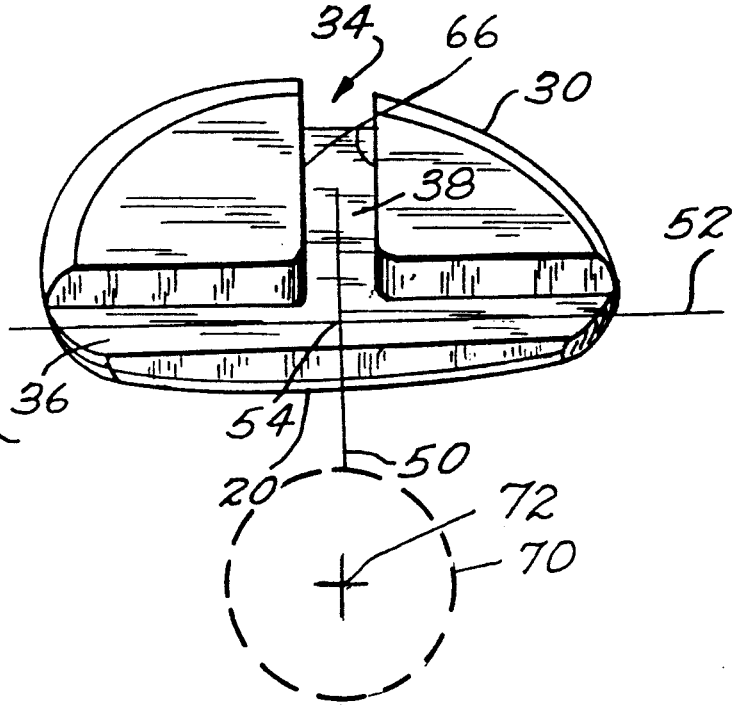

The invention is directed to a golf club as illustrated in FIGS. 1–8, and particularly a putter 10 comprising a head 12 having a shank opening 14 for receiving a shaft 16, which is secured to the opening 14 by a suitable adhesive (e.g., epoxy resin). The drawings are generally to scale. The head 12 has a planar striking face 18 disposed at a loft angle $\Theta$ from the vertical, preferably 2–4 degrees. The head 12 has a curved sole or bottom surface 20 and a curved top surface 21. The respective top and bottom surfaces 20 and 21 extend upwardly from the center and to the sides of the club and from front to back. The top surface 20 and bottom surface 21 have double curvatures, namely a side to side curvature $R_c$ (S-S) and front to rear curvature $R_c$ (F-R). In a preferred embodiment, the curvatures are the same and are preferably all about 14" side to side and front to back for the bottom ball to ball surface 20 and the top surface 21.

The side adjacent or proximate to the shaft 16 is known as the heel 24 and the distal or remote side is known as the toe 26. The head 12 has a curved rear surface 30 which extends rearwardly from the heel 24 to the toe 26. The upper surface 21 is formed with a "T" shaped recess 34 therein.

Figures 3, 4, 5, 6, 7, 8, 9:
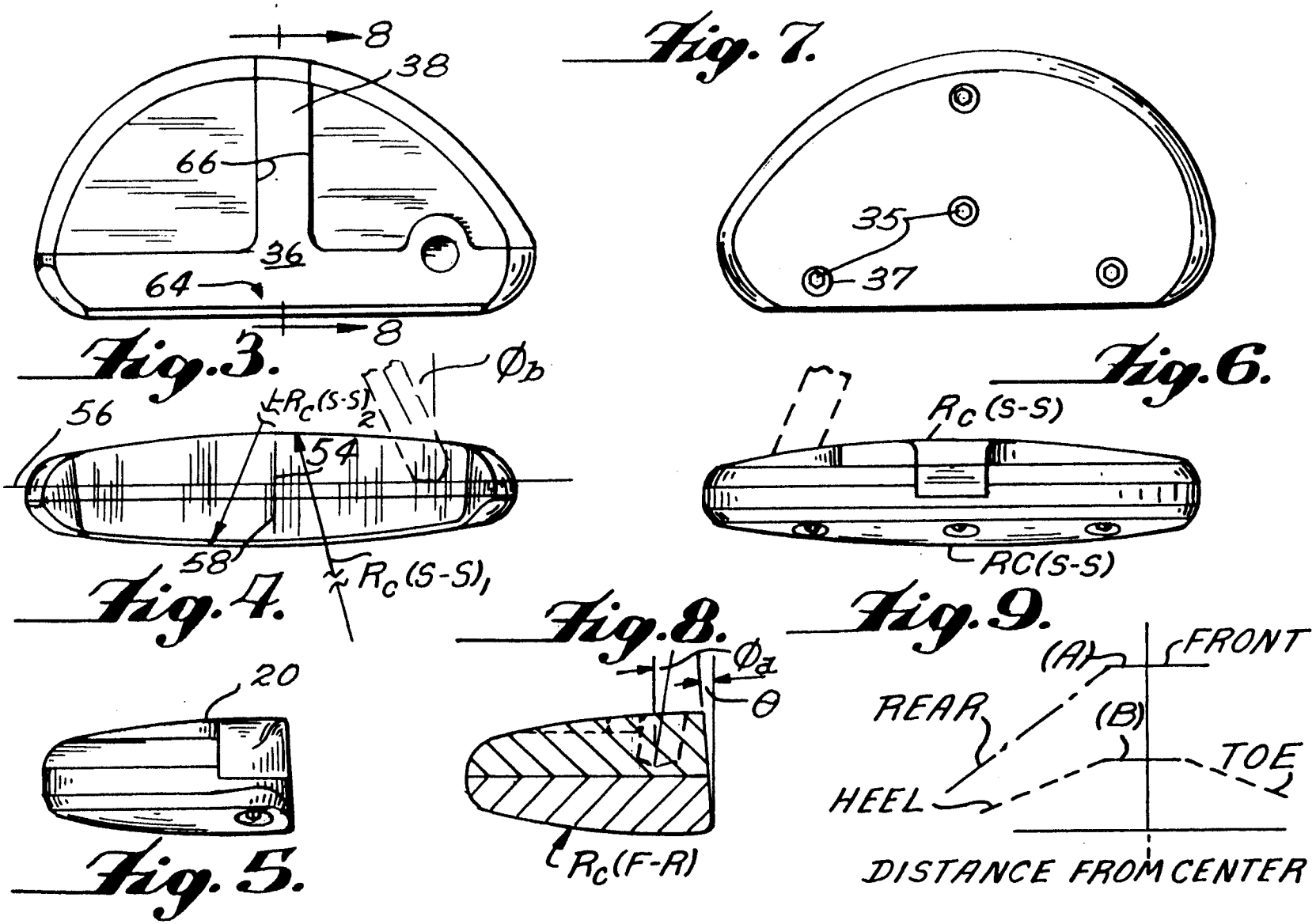
FIG. 3 is a top plan view of the golf putter head shown in FIG. 1.
FIG. 4 is a front elevation of the golf putter head.
FIG. 5 is a heel side elevation of the golf putter head.
FIG. 6 is a rear elevation of the golf putter head with the weight removed.
FIG. 7 is a bottom view of the golf putter head.
FIG. 8 is a cross-section taken along line 8—8 of FIG. 3.
FIG. 9 is a graphical representation of the weight distribution in the golf putter head as a function of distance from the center of mass.

The head 12 includes a weight 36 also formed in the shape of a "T" corresponding to the recess 34 which is secured therein by countersunk screws 35 located in corresponding aligned openings 37 in the bottom 20 and the weight 36 (FIGS. 6 and 7). The recess 34 has a lateral or tail portion 38 running front to rear and a transverse portion 40 running heel to toe as shown. The weight has corresponding lateral and traverse portions 44 and 46 for receiving the weight 36. The weight 36 has the shaft opening 14 formed therein and the shape of the weight is adjusted to account for the removed material from the opening 14. The shaft opening 14 is disposed at an angle $\phi$ within the weight 36 for receiving the curved shaft 16. The shaft curvature meets the USGA 5" standard for a bent putter shaft. Preferably the angle $\phi$ has a component $\phi_A$ which is about 11–21 degrees towards the face 18 and a component $\phi_B$ which is about 12–14 degrees towards the toe (see FIGS. 4, 6, and 8).

The head 12 has a lateral center line 50 which extends from the front striking surface 18 rearwardly of the club 10. The center line 50 is generally within the margins of the lateral slot 38. The mass of the club 10, including the head 12 and the weight 36, is distributed about one-half each on each side of the lateral center line 50. Likewise, club has a traverse center line 52 which runs from the heel to the toe and is perpendicular to the lateral center line 50. The mass of the club is concentrated near and is distributed about one-half each on each side of the traverse center line 52 as shown. The center of mass 54 of the club 10 is located on a vertical axis 58 in a plane 56 that includes center line 50 and 52, but which is elevated above the vertical center of the face 18. That is, the plane is closer to the upper surface 21 than the bottom surface 20. The plane 56, in general, is perpendicular to the vertical axis 58 which passes through the center of mass 54.

The head 12 is formed of a suitable material such as aluminum. The weight 36 is formed of a heavier or more dense material such as brass. Conventionally, as hereinafter noted, the different metals are distinguishable by color. The major portion of the weight 36 is located in the lateral slot 34, proximate to the center of mass 54. Thus, the actual mass of the club 10 is concentrated near the center of mass 54, and gradually decreases as the distance from the center of mass. FIG. 9, curve (A), illustrates the mass distribution of the weight 36 along the lateral line 50. Note that the mass concentration decreases with distance from the center of the mass 54, and that most of the mass is concentrated in a band, more or less defined by the lateral slot 38.

In the transverse or trailing direction, the weight 36 distribution, curve (B), is from the heel to the toe, but also decreases slightly with distance from the center line 50. According to the invention, the mass distribution causes the club to be face balanced so that the vertical axis 58 lies generally vertically and the face 18 is naturally drawn to a near vertical lie as a consequence. The mass of the club 10 is also concentrated in the lateral region where the striking force on the ball is optimized above the horizontal center of the club 10. Finally, the transverse distribution of the weight 36 provides rotational inertia to the club head 10, which stabilizes the club about the vertical axis 58. Thus, an off-center hit has less tendency to rotate the club and thereby result in a deflected shot and reduced power or striking force transmitted to the ball.

The shape of the club 10 also provides a relatively wide strike zone 64 or the so-called "sweet spot." About one-third of the club face 18, to each side of the center line 50, defines the hit or strike zone 64 (FIG. 4). Preferably, the sweet spot or strike zone 68 is about $\frac{5}{8}''$ on either side of the vertical center line 58. A hit in this region results in close to optimal strike force transmitted to the ball 70 without significant rotation of the head 12, such that the ball is not driven substantially off the target line.

The lateral or trailing portion 44 of the weight, shown in FIG. 3, also allows for visualization of the optimal strike zone 64. It is useful and desirable to accurately visualize the strike zone 64, because aiming at the ball center is more difficult than aiming at the ball width. The weight is not only shaped to better visualize the strike zone 64, it is a different color than the remaining part of the head. Thus, it is easy to see. If any two parts of the ball are within opposite margins 66 of the lateral slot 38, the center 72 of the ball 70 is within the strike zone 64 as shown by the dotted lines. Thus, the weight 36, and particularly the lateral portion 44, acts as an aiming device which also accurately gauges the ball margins.

As shown in FIG. 1, the weight 36 extends and is stepped above the upper surface 32 of the head 10, and tapers in the lateral and transverse directions to smoothly meet the rear of the club and the heel and toe portions respectively. This arrangement tailors the weight distribution about the respective lateral and transverse center lines 50 and 52. Also, this arrangement is aesthetically pleasing.

As noted above, the face 18 of the club is cut at angle Θ. In a preferred embodiment, Θ is about four degrees (4°) with respect to the vertical, as shown, to cause the club 10 to engage the ball 70 at a small upward angle. The angle may be changed, of course, although the 4° angle is chosen for what is thought to achieve the best result. The face 18 is burnished to enhance the strike force.

While there has been described what are at present is considered to be the preferred embodiment of the present invention, it will be apparent to those skilled in the art that various changes and modifications may be made therein without departing from the invention, and it is intended in the appended claims to cover such changes and modifications as fall within the spirit and scope of the invention.

What is claimed is:

1. A golf club head comprising: a body having a heel and a toe and a front and a rear, a striking face at the front extending from the heel to the toe and a recess near the front; a weighted mass being located in the recess and having a density greater than that of the body, said weighted mass extending from the heel to the toe in a plane substantially parallel to the face and having a central portion extending rearwardly from the face for providing a transverse mass distribution from the heel to the toe, the body and weighted mass having a combined center of mass at an intersection of a line running parallel to the face and centrally between the heel and toe in a line running centrally from the front to the rear, and a concentration of mass near said center of mass, for concentrating striking force in a region proximate to the line running from the front to the rear of the club, and the transverse mass distribution providing inertia to the club for reducing rotational motion when the striking force is within a strike zone proximate the center of mass.

2. The golf club head of claim 1 wherein the center of mass is elevated above a vertical center of the face.

3. The golf club head of claim 1 wherein the weight is T-shaped and the recess has a corresponding T-shape.

4. The golf club head of claim 1 wherein the mass distribution of the weighted mass decreases as the distance from the center of mass decreases.

5. The golf club head of claim 1 wherein the recess has margins adjacent each side of the line running from the front to the rear defining an aiming region.

6. The golf club head of claim 1 wherein the weight distribution of the club and the head is face balanced.

7. The golf club head of claim 1 wherein upper and lower surfaces of the head have curvatures from side to side and from front to rear.

8. The golf club head of claim 7 wherein the side to side curvature is about 14".

9. The golf club head of claim 7 wherein the front to rear curvature is about 14".

10. The golf club head of claim 1 wherein the head has a shaft opening for receiving a shaft and said opening lies at an angle relative to an upper surface of the club head.

11. The golf club head of claim 10 wherein the angle has a forward component towards the face and a transverse component towards the toe.

12. The golf club head of claim 11 wherein the forward component of the angle is about 11–21 degrees with respect to a vertical axis.

13. The golf club head of claim 11 wherein the traverse component of the angle is about 12–14 degrees with respect to a vertical axis.

14. The golf club head of claim 1 wherein the body is formed of aluminum and the weight is formed of brass.

15. The golf club head of claim 1 wherein the body and weight are visibly distinguishable by color.

16. The golf club head of claim 1 wherein the strike zone extends in the direction from the heel to the toe approximately ⅓ the width of the striking face centered about the center of mass.

17. The golf club head of claim 1 wherein the strike zone extends in the direction from the heel to the toe approximately ⅝" on each side of the center of mass.

* * * * *